US005104784A

United States Patent [19]

Shuto et al.

[11] Patent Number: 5,104,784

[45] Date of Patent: Apr. 14, 1992

[54] DIRECT POSITIVE PHOTOSENSITIVE MATERIAL

[75] Inventors: Sadanobu Shuto; Naoyasu Deguchi, both of Kanagawa, Japan

[73] Assignee: Fuji Photo Film Co., Ltd., Tokyo, Japan

[21] Appl. No.: 509,828

[22] Filed: Apr. 17, 1990

[30] Foreign Application Priority Data

Apr. 17, 1989 [JP] Japan ..... 1-95394

[51] Int. Cl.[5] ..... G03C 1/015; G03C 1/035

[52] U.S. Cl. ..... 430/567; 430/569; 430/598; 430/608; 430/611

[58] Field of Search ..... 430/608, 611, 598, 567, 430/569, 406

[56] References Cited

U.S. PATENT DOCUMENTS

| | | | |
|---|---|---|---|
| 3,047,393 | 1/1960 | Herz et al. | 430/607 |
| 3,977,880 | 10/1974 | Saito | 430/596 |
| 4,198,240 | 4/1980 | Mikawa | 430/570 |
| 4,897,343 | 1/1990 | Ikeda et al. | 430/570 |

FOREIGN PATENT DOCUMENTS

| | | |
|---|---|---|
| 327066 | 9/1989 | European Pat. Off. . |
| 358170 | 3/1990 | European Pat. Off. . |

*Primary Examiner*—Charles L. Bowers, Jr.
*Assistant Examiner*—Janet C. Baxter
*Attorney, Agent, or Firm*—Sughrue, Mion, Zinn, Macpeak & Seas

[57] ABSTRACT

A novel direct positive photosensitive material is provided comprising a support having therein at least one photographic emulsion layer containing internal latent image type silver halide grains not having been previously fogged, wherein the photographic emulsion layer comprises:

(1) at least one of compounds represented by the general formulae [I], [II] and [III]; and (2) at least one of compounds represented by the general formulae [IV], [V] and [VI]:

$$R—SO_2S—M \quad [I]$$

$$R—SO_2S—R^1 \quad [II]$$

$$R—SO_2S—Lm—S.O_2S—R^2 \quad [III]$$

wherein R, $R^1$ and $R^2$ may be the same or different and each represents an aliphatic group, aromatic group or heterocyclic group; M represents a cation; L represents a divalent connecting group; and m represents an integer 0 or 1;

$$M'_2SO_3 \quad [IV]$$

$$M'HSO_3 \quad [V]$$

$$M'_2S_2O_5 \quad [VI]$$

wherein M' represents a hydrogen atom or cation.

4 Claims, 1 Drawing Sheet

DIRECT POSITIVE PHOTOSENSITIVE MATERIAL

FIELD OF THE INVENTION

The present invention relates to a direct positive photosensitive material comprising at least one photographic emulsion layer containing internal latent image type silver halide grains not having been previously fogged which can exhibit a low minimum image density (Dmin) without lowering the maximum image density (Dmax) and a method for developing the same.

BACKGROUND OF THE INVENTION

A process has been well known which comprises imagewise exposure of an internal latent image type silver halide emulsion not having been previously fogged, and then subjecting the emulsion to surface development after or while being fogged, thereby obtaining a direct positive image.

Such an internal latent image type silver halide emulsion is a silver halide photographic emulsion of the type comprising a light-sensitive nucleus mainly inside silver haldie grains wherein latent images are formed mainly inside the grains upon exposure.

In the art, various techniques have been known. Main examples of such techniques include those described in U.S. Pat. Nos. 2,592,250, 2,466,957, 2,497,875, 2,588,982, 3,317,322, 3,761,266, 3,761,276, 3,796,577, 1,151,363, 1,150,553, and 1,011,062.

In accordance with these known approaches, a photosensitive material can be prepared with a relatively high sensitivity for direct positive type light-sensitive materials.

The mechanism of the formation of such a direct positive image is described in detail in T. H. James, "The Theory of the Photographic Process", 4th ed., Chap. 7, pp. 182–193, and U.S. Pat. No. 3,761,276.

The inventors previously worked on and applied a process for the preparation of a direct positive light-sensitive material with a low Dmin and high contrast by incorporating thiosulfonic acid in an emulsion (JP-A-1-254,946, the term of "JP-A" as used herein means an unexamined published Japanese patent application).

A direct positive photosensitive material must exhibit a high Dmax, a low Dmin and a high contrast to be put into practical use. In particular, such a direct positive photosensitive material is subject to a drop in Dmax when an additive is incorporated therein to lower Dmin.

In accordance with the method described in the above cited JP-A-1-254,946, a direct positive photosensitive material can be obtained with a low Dmin and a high contrast. However, such a direct positive photosensitive material is disadvantageous in that it exhibits a low fresh sensitivity and a large change in the sensitivity during aging upon storage (sensitization).

SUMMARY OF THE INVENTION

It is therefore an object of the present invention to provide a direct positive photosensitive material which can exhibit a low minimum image density and a high contrast without deteriorating the fresh sensitivity and the sensitivity during aging upon storage.

The above and other objects of the present invention will become more apparent from the following detailed description and examples.

These objects of the present invention are accomplished with a direct positive photosensitive material comprising a support having thereon at least one photographic emulsion layer containing internal latent image type silver halide grains not having been previously fogged, wherein the photographic emulsion layer comprises:

(1) at least one of compounds represented by the general formulae [I], [II] and [III]; and (2) at least one of compounds represented by the general formulae [IV], [V] and [VI]:

$$R—SO_2S—M \quad [I]$$

$$R—SO_2S—R^1 \quad [II]$$

$$R—SO_2S—Lm—S.O_2S—R^2 \quad [III]$$

wherein R, $R^1$ and $R^2$ may be the same or different and each represents an aliphatic group, aromatic group or heterocyclic group; M represents a cation; L represents a divalent connecting group; and m represents 0 or 1;

$$M'_2SO_3 \quad [IV]$$

$$M'HSO_3 \quad [V]$$

$$M'_2S_2O_5 \quad [VI]$$

wherein M' represents a hydrogen atom or cation.

BRIEF DESCRIPTION OF THE DRAWING

By way of example and to make the description more clear, reference is made to the accompanying drawing in which:

The Figure is a curve illustrating the characteristics of a direct positive image.

DETAILED DESCRIPTION OF THE INVENTION

Figure 1:
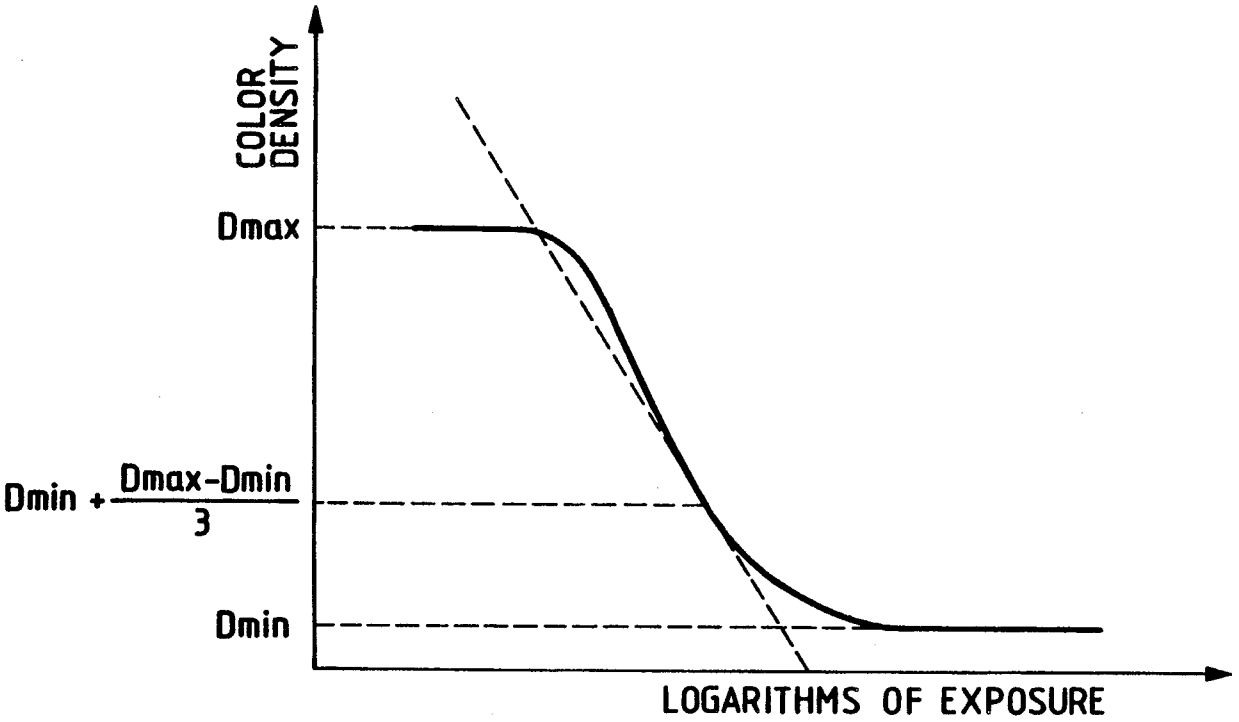

The compounds represented by the general formulae [I], [II] and [III] will be further described below.

$$R—SO_2S—M \quad [I]$$

$$R—SO_2S—R_1 \quad [II]$$

$$R—SO_2S—L_m—S.O_2S—R^2 \quad [III]$$

wherein R, $R^1$ and $R^2$ may be the same or different and each represents an aliphatic group, aromatic group or heterocyclic group; M represents a cation; L represents a divalent connecting group; and m represents 0 or 1.

If R, $R^1$ or $R^2$ is an aliphatic group, preferred examples of such an aliphatic groups include $C_{1-22}$ alkyl group and $C_{2-22}$ alkenyl and $C_{2-22}$ alkynyl groups which may contain substituents.

Examples of such an alkyl group include a methyl group, an ethyl group, a propyl group, a butyl group, a pentyl group, a hexyl group, an octyl group, a 2-ethylhexyl group, a decyl group, a dodecyl group, a hexadecyl group, an octadecyl group, a cyclohexyl group, an isopropyl group, and a t-butyl group.

Examples of the above described alkenyl group include an allyl group, and a butenyl group.

A preferred example of the aromatic group represented by R, $R^1$ or $R^2$ is a $C_{6-20}$ aromatic group. Examples of such an aromatic group include a phenyl group, and a naphthyl group. These groups may be substituted.

Preferred examples of the heterocyclic group represented by R, $R^1$ or $R^2$ include a 3- to 15-membered ring containing at least one element selected from nitrogen, oxygen, sulfur, selenium and tellurium. Examples of such a ring include a pyrrolidine ring, a piperidine ring, a pyridine ring, a tetrahydrofuran ring, a thiophene ring, an oxazole ring, a thiazole ring, an imidazole ring, a benzothiazole ring, a benzoxazole ring, a bnzimidazole ring, a selenazole ring, a benzoselenazole ring, a terrazole ring, a triazole ring, a benzotriazole ring, a tetrazole ring, an oxadiazole ring, and a thiadiazole ring.

Examples of substituents which can be contained in R, $R^1$ and $R^2$ include an alkyl group (e.g., methyl, ethyl, hexyl), an alkoxy group (e.g., methoxy, ethoxy, octyloxy), an aryl group (e.g., phenyl, naphthyl, tolyl), a hydroxy group, a halogen atom (e.g., fluorine, chlorine, iodine), an aryloxy group (e.g., phenoxy), an alkylthio group (e.g., phenylthio), an acyl group (e.g., acetyl, propionyl, butyryl, valeryl), a sulfonyl group (e.g., methylsulfonyl, phenylsulfonyl), an acylamino group (e.g., acetylamino, benzoylamino), a sulfonylamino group (e.g., methanesulfonylamino, benzenesulfonylamino), an acyloxy group (e.g., acetoxy, benzoxy), a carboxyl group, a cyano group, a sulfo group, and an amino group.

Preferred examples of the group represented by L include divalent aliphatic and aromatic groups.

Examples of such a divalent aliphatic group include $\leftarrow CH_2 \rightarrow$ (in which n represents an integer of 1 to 12), $-CH_2-CH=CH-CH_2-$, $-CH_2C\equiv CCH_2-$, and

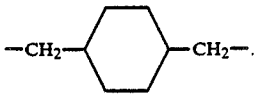

Examples of the divalent aromatic group represented by L include a phenylene group, and a naphthylene group.

These substituents may be further substituted by the substituents which have been described hereinbefore.

Preferred examples of M include metallic ions, and organic cations. Examples of organic ions include a lithium ion, a sodium ion, and a potassium ion. Examples of organic cations include an ammonium ion (e.g., ammonium, tetramethyl ammonium, tetrabutyl ammonium), a phosphonium ion (e.g., tetraphenyl phosphonium), and guandiyl.

Specific examples of compounds represented by the general formulae [I], [II] and [III] will be set forth below, but the present invention should not be construed as being limited thereto.

$CH_3SO_2SNa$ (I-1)
$C_2H_5SO_2SNa$ (I-2)
$C_3H_7SO_2SK$ (I-3)
$C_4H_9SO_2SLi$ (I-4)
$C_6H_{13}SO_2SNa$ (I-5)
$C_8H_{17}SO_2SNa$ (I-6)

$CH_3(CH_2)_3CH(C_2H_5)CH_2SO_2S.NH_4$ (I-7)

$C_{10}H_{21}SO_2SNa$ (I-8)
$C_{12}H_{25}SO_2SNa$ (I-9)
$C_{16}H_{33}SO_2SNa$ (I-10)

-continued

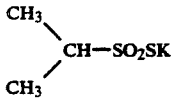
(I-11)

$t\text{-}C_4H_9SO_2SNa$ (I-12)
$CH_3OCH_2CH_2SO_2S.Na$ (I-13)

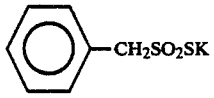
(I-14)

$CH_2=CHCH_2SO_2SNa$ (I-15)

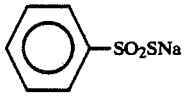
(I-16)

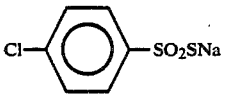
(I-17)

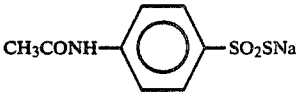
(I-18)

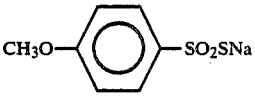
(I-19)

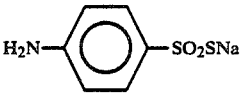
(I-20)

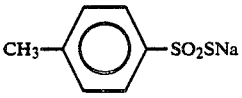
(I-21)

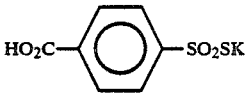
(I-22)

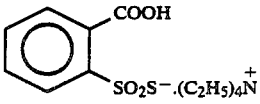
(I-23)

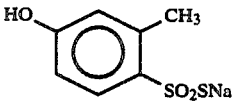
(I-24)

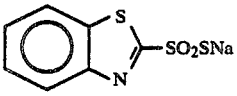
(I-25)

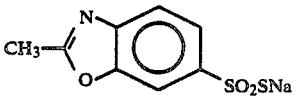
(I-26)

-continued
(I-27)
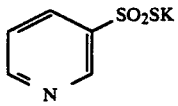
(I-28)
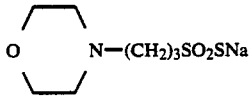
$C_2H_5SO_2S—CH_3$ (II-1)
$C_8H_17SO_2CH_2CH_3$ (II-2)
(II-3)
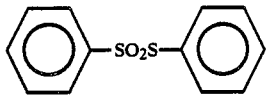
(II-4)
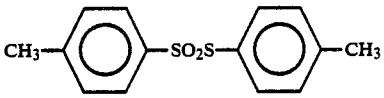
$C_2H_5SO_2SCH_2CH_2CN$ (II-5)
(II-6)
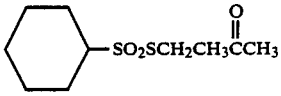
(II-7)
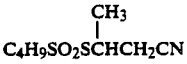
(II-8)
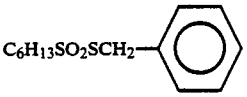
(II-9)
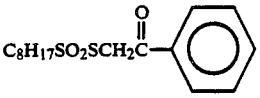
(II-10)
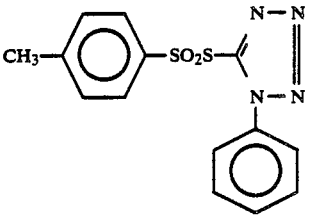
(II-11)
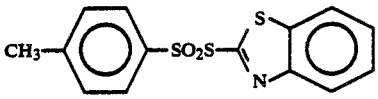
(II-12)
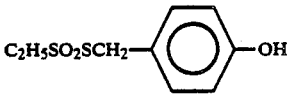
-continued
(II-13)
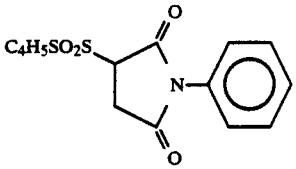
(II-14)
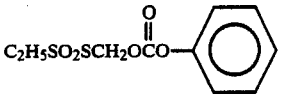
(II-15)
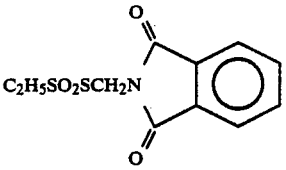
(II-16)
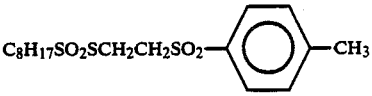
(II-17)
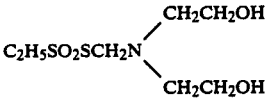
$C_2H_5SO_2SCH_2CH_2CH_2CH_2OH$ (II-18)
(II-19)
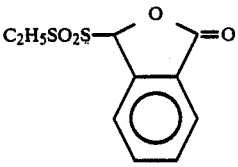
(II-20)
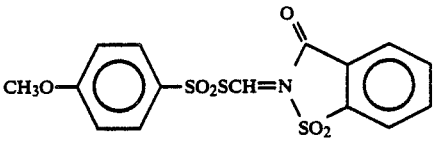
(III-1)
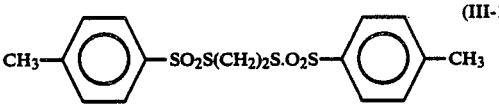
$C_2H_5SO_2SCH_2CH_2SO_2CH_2CH_2S.O_2SC_2H_5$ (III-2)
(III-3)
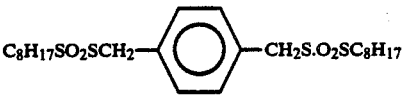
$C_2H_5SO_2SCH_2N(CH_2CH_2)NCH_2S.O_2SC_2H_5$ (III-4)
$CH_2CH_2OH$ $CH_2CH_2OH$
(III-5)
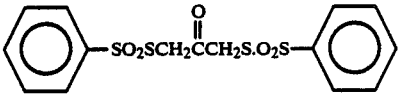

-continued

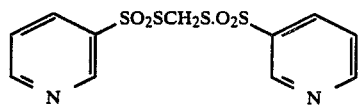

(III-6)

The synthesis of the compounds represented by the general formulae [I], [II] and [III] can be easily accomplished by any suitable method as described in JP-A-54-1019 (corresponding to U.S. Pat. No. 4,198,240) and British Patent 972,211.

Preferred among the compounds represented by the general formulae [I], [II] and [III] are those represented by the general formula [I].

The present compound represented by the general formula [I], [II] or [III] is incorporated in the present photographic emulsion layer containing internal latent image type silver halide grains.

The present compound represented by the general formula [I], [II] or [III] can be incorporated in a coating solution containing the emulsion grains shortly before coating. The present compound may preferably be previously incorporated in the present emulsion. Further preferably, the present compound represented by the general formula [I], [II] or [III] may be incorporated in the present internal latent image type silver halide grains which are being formed. Most preferably, the present compound represented by the general formula [I], [II] or [III] may be incorporated in a core/shell emulsion which is in the stage of formation, chemical sensitization or conversion of core grains.

The amount of the present compound represented by the general formula [I], [II] or [III] to be used is normally in the range of $10^{-6}$ to $10^{-2}$ mol, preferably $10^{-5}$ to $10^{-2}$ mol per mol of the present internal latent image type silver halide.

The present compounds represented by the general formula [I], [II] and [III] can be used alone or in combination.

The compounds represented by the general formulae [IV], [V] and [VI] will be further described below.

$$M'_2SO_3 \quad [IV]$$

$$M'HSO_3 \quad [V]$$

$$M'_2S_2O_5 \quad [VI]$$

wherein M' represents a hydrogen atom or cation.

Preferred examples of such a cation include metallic ions and organic cations. Examples of such a metallic ion include a lithium ion, a sodium ion, and a potassium ion. Examples of such an organic cation include an ammonium ion.

Specific examples of the compounds represented by the general formulae [IV], [V] and [VI] will be set forth below, but the present invention should not be construed as being limited thereto.

(IV-1) $Na_2SO_3$
(IV-2) $K_2SO_3$
(IV-3) $Li_2SO_3$
(IV-4) $(NH_4)_2SO_3$
(V-1) $NaHSO_3$
(V-2) $KHSO_3$
(V-3) $NH_4HSO_3$
(VI-1) $Na_2S_2O_5$
(VI-2) $K_2S_2O_5$
(VI-3) $(NH_4)_2S_2O_5$

These compounds can be easily prepared by, for example, passing sulfur dioxide through an aqueous solution or suspension of a metallic hydroxide or carbonate and are also commercially available.

The present compound represented by the general formula [IV], [V] or [VI] is incorporated in the present photographic emulsion layer containing internal latent image type silver halide grains.

The present compound represented by the general formula [IV], [V] or [VI] can be incorporated in a coating solution containing the emulsion grains shortly before coating. The present compound may preferably be previously incorporated in the present emulsion. Further preferably, the present compound represented by the general formula [IV], [V] or [VI] may be incorporated in the present internal latent image type silver halide grains which are being formed. Most preferably, the present compound represented by the general formula [IV], [V] or [VI] may be incorporated in a core/shell emulsion which is in the stage of formation, chemical sensitization or conversion of core grains.

The amount of the present compound represented by the general formula [IV], [V] or [VI] to be used is normally in the range of $10^{-7}$ to $10^{-3}$ mol, preferably $10^{-6}$ to $10^{-3}$ mol per mol of the present internal latent image type silver halide.

At least one of the present compounds represented by the general formulae [I], [II] and [III] and at least one of the present compounds represented by the general formulae [IV], [V] and [VI] can be incorporated in a coating solution containing the present internal latent image type silver halide grains or the internal latent image type silver halide emulsion at different times. The two components may be preferably incorporated in the coating solution or in the emulsion at the same time.

Alternatively, a solution obtained by mixing at least one of the present compounds represented by the general formulae [I], [II] and [III] with at least one of the present compounds represented by the general formulae [IV], [V] and [VI] in water or in an organic solvent can be incorporated in a coating solution containing the present internal latent image type silver halide grains or the internal latent image type silver halide emulsion.

The present internal latent image type silver halide emulsion layer is an emulsion of silver halide grains which have not been previously fogged and form latent images mainly thereinside. Specifically, the present internal latent image type silver halide emulsion layer is such that the maximum density determined by an ordinary photographic density measurement method on a specimen obtained by coating the silver halide emulsion on a transparent support in a predetermined amount (0.5 to 3 g/m$^2$), exposing the coated material to light over a predetermined time of 0.01 to 10 seconds, and then developing the material with the following developer A (internal latent image type) at a temperature of 18° C. over 5 minutes is at least 5 times, preferably at least 10 times that of another specimen obtained in the same manner as described above except that the development is effected with the following developer B (surface latent image type) at a temperature of 20° C. over 6 minutes.

| Internal Latent Image Type Developer A | |
|---|---|
| Metol | 2 g |

-continued

| | |
|---|---|
| Sodium sulfite (anhydride) | 90 g |
| Hydroquinone | 8 g |
| Sodium carbonate (monohydrate) | 52.5 g |
| KBr | 5 g |
| KI | 0.5 g |
| Water to make | 1 l |
| Surface Latent Image Type Developer B | |
| Metol | 2.5 g |
| L-ascorbic acid | 10 g |
| $NaBO_4.4H_2O$ | 35 g |
| KBr | 1 g |
| Water to make | 1 l |

Specific examples of such an internal latent image type emulsion include conversion type silver halide emulsions as described in U.S. Pat. No. 2,592,250, and core/shell type silver halide emulsions as described in U.S. Pat. Nos. 3,761,276, 3,850,637, 3,923,513, 4,035,185, 4,395,478 and 4,504,570, JP-A-52-156614, 55-127549, 53-60222, 56-22681, 59-208540, 60-107641, 61-3137, and 62-215272, and patents cited in Research Disclosure No. 23510 (November 1983), pp. 236.

The silver halide grains to be used in the present invention may have a regular crystal form such as cube, octahedron, dodecahedron and tetradecahedron, irregular crystal form such as sphere or a crystal form such as tabular having a length/thickness ratio of 5 or more. The present silver halide grains may have a composite of these crystal forms. The present silver halide emulsion may consist of a mixture of silver halide grains having these crystal forms.

The composition of the present silver halide emulsion may be silver chloride or a silver halide mixed with silver bromide. Examples of silver halides which can be preferably used in the present invention include silver bromochloride, silver chloride and silver bromide free of silver iodide or, if any, containing 3 mol % or less of silver iodide.

The average size of the silver halide grains to be used the present invention is preferably in the range of 0.1 μm to 2 μm, particularly 0.15 μm to 1 μm. The grain size distribution may be either narrow or wide. In order to improve the graininess or sharpness, a "monodisperse" silver halide emulsion wherein 90% or more of the total grains are within ±40%, preferably ±20% of the average grain size by the number of grains or by weight may be preferably used in the present invention. In order to satisfy the gradation required for the light-sensitive material, two or more monodisperse silver halide emulsions having different grain sizes or an emulsion of a plurality of silver halide grains having the same size but different sensitivities may be coated on the same layer in admixture or coated on separate layers. Furthermore, two or more polydisperse silver halide emulsions or a combination of a monodisperse emulsion and a polydisperse emulsion can be coated on the same layer in admixture or coated as separate layers.

The silver halide emulsion to be used in the present invention may be subjected to chemical sensitization in its inside or on its surface by a selenium sensitization process, a reduction sensitization process, a noble metal sensitization or the like, singly or in combination. Specific examples of such chemical sensitization processes are described in Research Disclosure No. 17643-III (December 1978), pp. 23.

The photographic emulsion to be used in the present invention may be subjected to spectral sensitization with a photographic sensitizing dye by any suitable ordinary method. Particularly useful examples of such a photographic sensitizing dye include a cyanine dye, a melocyanine dye and a composite merocyanine dye. These dyes can be used singly or in combination. These dyes can be used in combination with a supersensitizer. Specific examples of such a supersensitizer are described in patents cited in Research Disclosure No. 17643-IV (December 1978), pp. 23–24.

The photographic emulsion to be used in the present invention may comprise a fog inhibitor or stabilizer for the purpose of inhibiting fog during the preparation, preservation or photographic processing of the light-sensitive material or stabilizing the photographic properties of the light-sensitive material. Specific examples of such a fog inhibitor or stabilizer are described in Research Disclosure No. 17643-VI (December 1978) and E. J. Birr, "Stabilization of Photographic Silver Halide Emulsion" (Focal Press), 1974.

In the present invention, various color couplers can be used to form a direct positive color image. Such color couplers are preferably compounds which undergo a coupling reaction with an oxidation product of an aromatic primary amine color developing agent to form or release a substantially nondiffusive dye and are substantially nondiffusive themselves. Typical examples of useful color couplers include naphtholic or phenolic compounds, pyrazolone or pyrazoloazole compounds, and open-chain or heterocyclic ketomethylene compounds. Specific examples of these cyan, magenta and yellow couplers which can be used in the present invention are described in Research Disclosure No. 17643 (December 1978), pp. 25, Article VII-D and No. 187717 (November 1979), Japanese Patent Application No. 61-32462, and patents cited therein.

Alternatively, colored couplers for eliminating undesired absorption by dyes produced in a short wavelength range, couplers which form dyes having a proper diffusibility, colorless couplers, DIR couplers which undergo a coupling reaction to release a development inhibitor, and polymerized couplers may be used.

As a binder or protective colloid to be incorporated in the emulsion layer or intermediate layer in the present light-sensitive material, gelatin can be advantageously used. Other hydrophilic colloids can also be used.

Color fog inhibitors or color stain inhibitors can be incorporated in the present light-sensitive material Typical examples of these color fog inhibitors and color stain inhibitors are described in JP-A-62-215272 (pp. 185–193).

In the present invention, a color booster may be used for the purpose of improving the coloring properties of couplers. Typical examples of such a compound are described in JP-A-62-215272, pp. 1212–125.

The present light-sensitive material may comprise a dye for inhibiting irradiation or halation, an ultraviolet absorbent, a plasticizer, a fluorescent brightening agent, a matting agent, an air fog inhibitor, a coating aid, a film hardener, an antistatic agent, a smoothness improver and the like. Typical examples of these additives are described in Research Disclosure No. 17643, VII-XIII, (December 1978), pp. 25–27, and No. 18716 (November 1979), pp. 647–651.

The present invention can be applied to a multi-layer multi-color photosensitive material having at least two different spectral sensitivities on a support. A multi-layer natural color photosensitive material normally comprises at least one red-sensitive emulsion layer, at least one green-sensitive emulsion layer and at least one blue-sensitive emulsion layer on a support. The order of the arrangement of these layers can be optionally selected. A preferred example of the arrangement of these layers is in the order of a red-sensitive emulsion layer, a green-sensitive emulsion layer and a blue-sensitive emulsion layer or a green-sensitive emulsion layer, a red-sensitive emulsion layer and a blue-sensitive emulsion layer as viewed from the support side. Each of these emulsion layers may consist of two or more emulsion layers having different sensitivities. Alternatively, a light-insensitive layer may be present between two or more emulsion layers having the same color-sensitivity. In general, the red-sensitive emulsion layer comprises a cyan-forming coupler, the green-sensitive emulsion layer comprises a magenta-forming coupler, and the blue-sensitive emulsion layer comprises a yellow-forming coupler. Different combinations may be optionally used.

The light-sensitive material of the present invention may preferably comprise auxiliary layers such as a protective layer, an intermediate layer, a filter layer, an antihalation layer, a backing layer and a white reflecting layer besides a silver halide emulsion layer.

In the photosensitive material of the present invention, the photographic emulsion layer and other layers may be coated onto any suitable support as described in Research Disclosure No. 17643, VVII, December 1978, p 28, European Patent 102,253, and JP-A-61-97655. Alternatively, a coating process as described in Research Disclosure No. 17643, XV, pp. 28–29, can be employed in the present invention.

Examples of support include films of semi-synthetic or synthetic polymers, such as cellulose nitrate, cellulose acetate, cellulose acetate butyrate, polystyrene, poly(vinyl chloride), poly(ethylene terphthalate), polycarbonate, and etc., and papers coated or laminated with baryta layer or α-olefinic polymer such as polyethylene, polypropylene, ethylene/butene copolymer, and etc. The support may be colored with dyes or pigments which includes black color for shielding light.

A surface of the support may be subbing-treated so as to improve adhesive property with a photographic emulsion layer. The surface may be treated with glow discharge, corona discharge, UV irradiation, or flame, prior to or in advance of the subbing treatment.

The present invention can also be applied to various color light-sensitive materials.

Typical examples of such color light-sensitive materials include color reversal film for television, color reversal paper, and instant color film. Furthermore, the present invention can be applied to light-sensitive materials for full-color copying machines or color hard copying paper for storing CRT images. Moreover, the present invention can be applied to a black-and-white light-sensitive material utilizing a mixture of three color couplers as described in Research Disclosure No. 17123, July 1978.

Still further, the present invention can be applied to a black-and-white photosensitive material.

Examples of black-and-white photosensitive materials to which the present invention can be applied include black-and-white direct positive photosensitive materials as described in JP-A-59-208540 and 60-260039 (e.g., X-ray light-sensitive materials, dupe light-sensitive materials, microphotosensitive materials, light-sensitive materials for photography, and printing light-sensitive materials).

The present fogging process may be effected in the "light fogging process" and/or "chemical fogging process" as described below. In the present "light fogging process", the entire exposure or fogging exposure may be effected after imagewise exposure or after and/or during development. A light-sensitive material which has been imagewise exposed to light may be subjected to such fogging exposure while being immersed in a developing solution or its prebath or before being dried after being withdrawn from these baths, most preferably while being immersed in a developing solution.

As a light source to be used for the fogging exposure, a light source emitting light of a wavelength within the range to which the light sensitive material is sensitive may be used. In general, a fluorescent light, a tungsten lamp, a xenon lamp, sunshine, and the like can be used. Processes for the use of these light sources are described in British Patent 1,151,363, JP-B-45-12710 (the term "JP-B" as used herein means an "examined Japanese patent publication"), 45-12709, and 58-6936, and JPA-48-9727, 56-137350, 57-129438, 58-62652, 58-60739, 58-70223 (corresponding to U.S. Pat. No. 4,440,851), and 58-120248 (corresponding to European Patent 89101A2). For light-sensitive materials which are sensitive to all wavelength ranges, such as color light-sensitive materials, a light-sensitive material with a high color rendering (as nearer to white as possible) as described in JP-A-56-137350 and 58-70223 may be preferably used. These light sources may have an illuminance of 0.01 to 2,000 lux, preferably 0.05 to 30 lux, particularly 0.05 to 5 lux. As the sensitivity of the emulsion contained in the light-sensitive material is higher, the light-sensitive material may be preferably exposed at a lower intensity. The adjustment of the intensity can be accomplished by altering the luminous intensity of the light source or altering the sensitivity provided by various filters, the distance between the light-sensitive material and the light source or the angle between the light-sensitive material and the light source. Alternatively, the intensity of the fogging light can be increased continuously or by stages from a low to a high value.

The light-sensitive material may be preferably irradiated with light after the emulsion layer is thoroughly impregnated with a processing solution while being immersed in a developing solution or its prebath. The time between the thorough impregnation and the light fogging exposure is normally in the range of 2 seconds to 2 minutes, preferably 5 seconds to 1 minute, more preferably 10 seconds to 30 seconds.

The time for the fogging exposure is normally in the range of 0.01 second to 2 minutes, preferably 0.1 second to 1 minute, more preferably 1 second to 40 seconds.

In the present invention, a nucleating agent to be used in the so-called "chemical fogging process" may be incorporated in the light-sensitive material or a solution for processing the light-sensitive material, preferably in the light-sensitive material.

The term "nucleating agent" as used herein means a substance which serves to act on an internal latent image type silver halide emulsion not having been previously fogged upon the surface development thereof to form a direct positive image. In the present invention, the fogging process may be particularly preferably effected with such a nucleating agent.

If the nucleating agent is incorporated in the light-sensitive material, it may be preferably incorporated in the internal latent image type silver halide emulsion layer. Alternatively, the nucleating agent may be incorporated in other layers such as an intermediate layer, a subbing layer or a backing layer, so long as it is dispersed in and adsorbed by silver halide grains during coating or processing.

If the nucleating agent is incorporated in the processing solution, it may be incorporated in a developing solution or a low pH prebath as described in JPA-58-178350.

Two or more nucleating agents can be used in combination.

As the nucleating agents to be used in the present invention compounds represented by the general formulae [N-I] and [N-II] may be used:

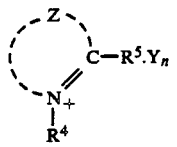

[N-I]

wherein Z represents a nonmetallic atom group required to form a 5- to 6-membered heterocyclic group and may be substituted by substituents; $R^4$ represents an aliphatic group; $R^5$ represents a hydrogen atom, aliphatic group or aromatic group; $R^4$ and $R^5$ may be substituted by substituents; $R^5$ may be connected to a heterocyclic group formed of Z to form a ring; at least one of the substituents contained in $R^4$, $R^5$ and Z may contain a group for accelerating the adsorption by silver halide; Y represents a paired ion for charge balance; and n represents 0 or 1, with the proviso that at least one of the groups represented by $R^4$, $R^5$ and Z contains an alkynyl group, acyl group, hydrazine group or hydrazone group or $R^5$ and $R^5$ together form a 6-membered ring to form a dihydropyridinium skeleton.

Specific examples of the compound represented by the general formula [N-1] will be set forth below.

(N-I-1) 5-Ethoxy-2-methyl-1-propargylquinolinium bromide (N-I-2) 2,4-Dimethyl-1-propargylquinolinium bromide (N-I-3) 3,4-Dimethyl-dihydropyrido[2,1-b] benzothiazolium bromide (N-I-4) 6-Ethoxythiocarbonylamino-2-methyl-1-propargylquinolinium trifluoromethanesulfonate (N-I-5) 6-(5-Benzotriazolecarboxamide)-2-methyl-1-propargylquinolinium trifluoromethanesulfonate (N-I-6) 6-(5-Mercaptotetrazol-1-yl)-2-methyl-1-propargylquinolinium iodide (N-1-7) 6-Ethoxythiocarbonylamino-2-(2-methyl-1-propenyl)-1-propargylquinolinium trifluoromethanesulfonate (N-I-8) 10-Propargyl-1,2,3,4-tetrahydroacrydinium trifluoromethanesulfonate (N-I-9) 7-Ethoxythiocarbonylamino-10-propargyl-1,2,3,4-tetrahydroacrydinium trifluoromethanesulfonate (N-I-10) 7-[3-(5-mercaptotetrazol-1-yl)benzamide]-10-propargyl-1,2,3,4-tetrahydroacrydinium perchlorate (N-I-11) 7-(5-Mercaptotetrazol-1-yl)-9-methyl-10-propargyl-1,2,3,4-tetrahydroacrydinium bromide (N-I-12) 7-Ethoxythiocarbonylamino-10-propargyl-1,2-dihydroacrydinium trifluoromethanesulfonate (N-I-13) 10-Propargyl-7-[3-(1,2,3,4-thiatriazol-5-ylamino)benzamide]-1,2,3,4-tetrahydroacrydinium perchlorate (N-I-14) 7-(3-Cyclohexylmethoxythiocarbonylaminobenzamide) -10 - propargyl-1,2,3,4- tetrahydroacrydinium trifluoromethanesulfonate (N-I-15) 7-(3-Ethoxythiocarbon-vlaminobenzamide)-10-propargyl-1,2,3,4 -tetrahydroacrydinium trifluoromethanesulfonate (N-I-16) 7-[3-(3-Ethoxythiocarbonylaminophenyl-)ureido]-10 -propargyl -1,2,3,4 -tetrahydroacrydinium trifluoromethanesulfonate (N-I-17) 7-(3-Ethoxythiocarbonylaminobenzenesulfonamide) - 10 -propargyl -1,2,3,4-tetrahydroacrydinium trifluoromethanesulfonate (N-I-18) 7-[3-{3-[3-(5-Mercaptotetrazol-1-yl)phenyl-]ureido}benzamide]-10-propargyl-1,2,3,4-tetrahydroacrydinium trifluoromethanesulfonate (N-I-19) 7-[3-(5-Mercapto-1,3,4-thiadiazol-1-ylamino) benzamide]-10-propargyl-1,2,3,4-tetrahydroacrydinium trifluoromethanesulfonate (N-I-20) 7-[3-(3-Butylthioureido)benzamide]-10-propargyl-1,2,3,4-tetrahydroacrydinium trifluoromethanesulfonate

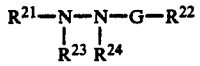

[N-II]

wherein $R^{21}$ represents an aliphatic group, aromatic group or heterocyclic group; $R^{22}$ represents a hydrogen atom, alkyl group, aralkyl group, aryl group, alkoxy group, aryloxy group or amino group; G represents a carbonyl group, sulfonyl group, sulfoxy group phosphoryl group or iminomethylene group (HN=C<); and $R^{23}$ and $R^{24}$ each represents a hydrogen atom or one of $R^{23}$ and $R^{24}$ represents a hydrogen atom and the other represents any one of an alkylsulfonyl group, an arylsulfonyl group and an acyl group, with the proviso that G, $R^{22}$, $R^{24}$ and a hydrazine nitrogen may together form a hydrazo structure (<N—N=>). These groups may be optionally substituted by substituents.

Specific examples of the compound represented by the general formula [N-II] will be set forth below.

(N-II-1) 1-Formyl-2-{4-[3-(2-methoxyphenyl)ureido]-phenyl}hydrazine (N-II-2) 1-Formyl-2-{4-[3-{3-[3-(2,4-di-tertpentylphenoxy) propyl]ureido}phenylsulfonylamino]-phenyl}hydrazine (N-II-3) 1-Formyl-2-(4-[3-(5-mercaptotetrazol-1-yl) benzamide]phenyl}hydrazine (N-II-4) 1-Formyl-2-[4-{3-[3-(5-mercaptotetrazol-1-yl) phenyl]ureido}phen-vl]hydrazine (N-II-5) 1-Formyl-2-[4-(3-[N-(5-mercapto-4-methyl-1,2,4-triazol-3-yl) carbamoyl]propaneamide}phenyl]-hydrazine (N-II-6) 1-Formyl-2-{4-[3-(N-[4-(3-mercapto-1,2,4-triazol-4-yl) phenyl]carbamoyl}-propaneamide]-phenyl}hydrazine (N-II-7) 1-Formyl-2-[4-(3-[N-(5-mercapto-1,3,4-thiadiazole-2-yl) carbamoyl]propaneamide}phenyl] -hydrazine (N-II-8) 2-[4-(Benzotriazole-5-carboxamide)phenyl]-1-formylhyirazine (N-II-9) 2-[4-{3-[N-(Benzotriazole-5-carboxamide) carbamoyl]propaneamide}phenyl]-1-formylhydrazine (N-II-10) 1-Formyl-2-{4-[1-(N-phenylcarbamoyl) thiosemicarbamoyl)thiosemicarbazide]phenyl}hydrazine (N-II-11) 1-Formyl-2-{4-[3-(3-phenylthioureido)benzamide]phenyl}hydrazine (N-II-12) 1-Formyl-2-[4-(3-hexylureido)phenyl]hydrazine (N-II-13) 1-Formyl-2-(4-[3-(5-mercaptotetrazol-1-yl) benzenesulfonamide]phenyl}hydrazine (N-II-14) 1-Formyl-2-{4-[3-{3-[3-(5-mercaptotetrazol-1-yl) phenyl]ureido}benzenesulfonamide]phenyl}hydrazine (N-II-15) 1-Formyl-2-[4-(3-[3-(2,4-di-tert-pentylphenoxy) propyl]ureido}phenyl]hydrazine.

The nucleating agent to be used in the present invention may be incorporated in the light-sensitive material or a solution for processing the light-sensitive material, preferably in the light-sensitive material.

If the nucleating agent is incorporated in the light-sensitive material, it may be preferably incorporated in the internal latent image type silver halide emulsion layer. The nucleating agent may be incorporated in other layers, such as an intermediate layer, a subbing layer and a backing layer, so long as it is dispersed in these layers and then adsorbed by silver halide grains. If the nucleating agent is incorporated in the processing solution, it may be incorporated in the developing solution or a low pH prebath as described in JP-A-58-178350.

If the nucleating agent is incorporated in the light-sensitive material, the amount of the nucleating agent to be used is preferably in the range of $10^{-8}$ to $10^{-2}$ mol, more preferably $10^{-7}$ to $10^{-3}$ mol per mol of silver halide.

If the nucleating agent is incorporated in the processing solution, the amount of the nucleating agent to be used is preferably in the range of $10^{-5}$ to $10^{-1}$ mol/1, more preferably $10^{-4}$ to $10^{-2}$ mol/1.

In the present invention, the following nucleation accelerators may be used to accelerate the effect of the above described nucleating agents in an amount of $10^{-6}$ to $10^{-2}$ mol, preferably $10^{-5}$ to $10^{-2}$ mol per mol of silver halide For example, tetrazaindenes, triazaindenes and pentazaindenes which may be optionally substituted by alkaline metal atoms or ammonium groups and contain at least one mercapto group and compounds as described in JP-A-106656, pp. 6-16, may be used.

Specific examples of such nucleating accelerators will be set forth below, but the present invention should not be construed as being limited thereto.

(A-1) 3-Mercapto-1,2,4-triazolo[4,5-a]pyridine (A-2) 3-Mercapto-1,2,4-triazolo[4,5-a]pyrimidine (A-3) 5-Mercapto-1,2,4-triazolo[1,5-a]pyrimidine (A-4) 7-(2-Dimethylaminoethyl)-5-mercapto-1,2,4-triazolo[1,5-a]pyrimidine (A-5) 3-Mercapto-7-methyl-1,2,4-triazolo[4,5- a]pyrimidine (A-6) 3,6-Dimercapto-1,2,4-triazolo[4,5-b]pyridazine (A-7) 2-Mercapto-5-methylthi-o-1,3,4-thiadiazole (A-8) 3-Mercapto-4-methyl-1,2,4-triazole (A-9) 2-(3-Dimethylaminopropylthio)-5-mercapto-1,3,4-thiadiazole hydrochlorate (A-10) 2-(2-Morpholinoethylthio)-5-mercapto-1,3,4-thiadiazole hydrochlorate The nucleating agent may be incorporated in the light-sensitive material or processing solution as described above. The nucleating agent may be preferably incorporated in the internal latent image type silver halide emulsion layer or other hydrophilic colloid layers (e.g., intermediate layer and protective layer), particularly the silver halide emulsion layer or its adjacent layers in the light-sensitive material.

The color developing solution to be used for the development of the present light-sensitive material is preferably an alkaline aqueous solution comprising an aromatic primary amine color developing agent as a main component. Aminophenolic compounds are useful as such color developing agents. p-Phenylenediamine compounds may be more preferably used. Typical examples of such p-phenylenediamine compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamideethylaniline, 3-methyl-4-amino-N-ethyl-N-β-N-β-methoxyethylaniline, and sulfates, hydrochlorates and p-toluenesulfonates thereof. These compounds can be used in combination depending on the purpose of application.

These color developing solutions may have a pH value of 9 to 12, preferably 9.5 to 11.5.

The photographic emulsion layer which has been subjected to color development is normally subjected to bleach. The bleaching may be effected simultaneously with (blix) or separatel from fixing. In order to expedite the processing the fixing may be effected after the bleaching. A blix bath comprising two continuous tanks may be used. Alternatively, the fixing may be effected before blix. Furthermore, the bleaching may be effected after blix. These alternatives can be optionally effected depending on the purpose of application.

The present silver halide color photographic material is normally subjected to a rinse and/or stabilizing after desilvering. The amount of water to be used in the rinsing step can be determined in a wide range depending on the properties of the light-sensitive material (e.g., as determined by the type of materials used, such as couplers), the purpose of the light-sensitive material, the temperature of washing water, the number of washing tanks (stages), the replenishment process (countercurrent or forward current) or other various conditions. The relationship between the number of washing tanks and the amount of water to be used in the multistage countercurrent process can be determined by any suitable method as described in the Journal of the Society of Motion Picture and Television Engineers, Vol. 64, p 248-253, May 1955.

The present silver halide color photographic material may comprise a color developing agent for the purpose of simplifying and expediting the processing. Such a color developing agent can be incorporated in the light-sensitive material in the form of its precursor.

On the other hand, various known developing agents can be used to develop a black-and-white light-sensitive material in the present invention. In particular, polyhydroxybenzenes such as hydroquinone, 2-chlorohydroquinone, 2-methylhydroquinone, catechol and pyrogallol, aminophenols such as p-aminophenol, N-methyl-p-aminophenol and 2,4-diaminophenol, 3-pyrazolidones such as 1- phenyl -3-pyrazolidone, 1-phenyl-4,4,-dimethyl-3-pyrazolidone, 1-phenyl-4-methyl-4-hydroxymethyl-3-pyrazolidone and 5,5-dimethyl-1-phenyl-3-pyrazolidone, and ascorbic acids can be used alone or in combination. Alternatively, developing solutions as described in JP-A-58-55928 can be used in the present invention.

The present invention will be further described in the following examples, but the present invention should not be construed as being limited thereto.

Unless otherwise indicated, all percents, ratio, parts, etc. are by weight.

EXAMPLE 1

Preparation of Emulsion A-1

An aqueous solution of potassium bromide and an aqueous solution of silver nitrate were simultaneously added to an aqueous solution of gelatin comprising 3,4-dimethyl-1,3-thiazoline-2-thione in an amount of 0.3 g per mol of Ag with vigorous stirring at a temperature of 70° C. over about 20 minutes. As a result, a monodisperse emulsion of octahedral silver bromide core grains having an average diameter of about 0.40 μm was obtained. The emulsion was then heated to a temperature of 75° C. over 80 minutes with 6 mg/mol Ag of sodium thiosulfate and 7 mg/mol Ag of chloroauric acid (tetrahydrate) so that the core grains were subjected to chemical sensitization. The silver bromide core grains were then subjected to shell formation in the same precipitation atmosphere as above. Eventually, a core/shell type monodisperse emulsion of silver bromide grains having an average diameter of about 0.6 μm was obtained. The coefficient of fluctuation in the sizes of the silver bromide grains was about 10%.

The emulsion was then heated to a temperature of 65° C. over 60 minutes with 1.5 mg/mol Ag of sodium thiosulfate and 1.5 mg/mol Ag of chloroauric acid (tetrahydrate) so that the shell of the silver bromide grains were subjected to chemical sensitization. As a result, an internal latent image type silver halide emulsion A-1 was obtained.

Emulsions A-2 to A-20 were then prepared in the same manner as for Emulsion A-1 except that the compounds set forth in Table 1 were incorporated in the material shortly after the formation of the core emulsion, respectively.

TABLE 1

| Emulsion No. | Compound (I)-(III) added amount (mol/mol Ag) | Compound (IV)-(VI)/ added amount (mol/mol Ag) |
|---|---|---|
| A-1 | — | — |
| A-2 | (I-2) $5 \times 10^{-4}$ | — |
| A-3 | (I-6) $5 \times 10^{-4}$ | — |
| A-4 | (I-16) $5 \times 10^{-4}$ | — |
| A-5 | (II-3) $5 \times 10^{-4}$ | — |
| A-6 | (III-1) $5 \times 10^{-4}$ | — |
| A-7 | — | (IV-1) $3 \times 10^{-4}$ |
| A-8 | — | (IV-4) $3 \times 10^{-4}$ |
| A-9 | — | (V-1) $3 \times 10^{-4}$ |
| A-10 | — | (VI-2) $3 \times 10^{-4}$ |
| A-11 | (I-2) $5 \times 10^{-4}$ | (IV-1) $3 \times 10^{-4}$ |
| A-12 | (I-6) $5 \times 10^{-4}$ | (IV-1) $3 \times 10^{-4}$ |
| A-13 | (I-16) $5 \times 10^{-4}$ | (IV-1) $3 \times 10^{-4}$ |
| A-14 | (II-3) $5 \times 10^{-4}$ | (IV-1) $3 \times 10^{-4}$ |
| A-15 | (III-1) $5 \times 10^{-4}$ | (IV-1) $3 \times 10^{-4}$ |
| A-16 | (I-16) $5 \times 10^{-4}$ | (IV-4) $3 \times 10^{-4}$ |
| A-17 | (I-16) $5 \times 10^{-4}$ | (V-1) $3 \times 10^{-4}$ |
| A-18 | (I-16) $5 \times 10^{-4}$ | (VI-2) $3 \times 10^{-4}$ |
| A-19 | (I-16) $2.5 \times 10^{-4}$, and (II-3) $2.5 \times 10^{-4}$ | (IV-1) $3 \times 10^{-4}$ |
| A-20 | (I-16) $5 \times 10^{-4}$ | (IV-1) $1.5 \times 10^{-4}$ and (VI-2) $1.5 \times 10^{-4}$ |

Emulsion A-1 thus prepared was then used to prepare a photosensitive material having the following composition. As a support a 100-μm thick paper laminated with polyethylene on both sides thereof was used. The paper support contained titanium white as a white pigment on the side on which the emulsion was coated.

Composition of the light-sensitive layer

The composition used and their coated amount in g/m² will be set forth below. The coated amount of silver halide is represented as calculated in terms of amount of silver.

| | |
|---|---|
| 1st layer (red-sensitive emulsion layer) | |
| Emulsion A-1 spectrally sensitized with red sensitizing dyes (ExS-1, 2,3) | 0.30 |
| Gelatin | 2.00 |
| Cyan coupler (ExC-1) | 0.35 |
| Cyan coupler (ExC-2) | 0.35 |
| Discoloration inhibitor (Cpd-1,2, 3,4 at an equal ratio) | 0.30 |
| Coupler dispersant (Cpd-6) | 0.06 |
| Coupler dispersant (Solv-1, 2,3 at an equal ratio) | 0.20 |
| 2nd layer (protective layer) | |
| Acryl-modified copolymer of polyvinyl alcohol (modification degree: 17%) | 0.04 |
| Polymethyl methacrylate grains (average grain size: 2.4 μm) and silicon oxide grains (average size: 5 μm) at an equal ratio | 0.10 |
| Gelatin | 3.00 |
| Gelatin hardener (H-1) | 0.34 |

In the 1st layer, as nucleating agent there was used ExZK-1 in an amount of $10^{-3}$% by weight based on the coated amount of silver halide. As nucleation accelerator there was used Cpd-22 in an amount of $10^{-2}$% by weight based on the coated amount of silver halide In each layer, as emulsion dispersion aids there were used Alkanol XC (Dupont) and sodium alkylbenzenesulfonate. As coating aids there were used ester succinate and Magefac F-120 (Dainippon Ink And Chemicals). In the 1st layer, as stabilizers there were used Cpd-23, 24 and 25. The specimen thus prepared was used as Specimen 101. The compounds used in the present example are set forth in Example 5.

Specimens 102 to 120 were prepared in the same manner as in Specimen 101 except that Emulsions A-2 to A- 20 were used instead of Emulsion A-1, respectively.

These specimens were then wedgewise exposed to light through a red filter over 1/10 second (20 CMS) and subjected to the following development.

| Processing Step | Time (sec.) | Temp. (°C.) | Running Solution Tank Volume (l) | Replenishment Rate (ml/m²) |
|---|---|---|---|---|
| Color development | 135 | 38 | 11 | 300 |
| Blix | 40 | 33 | 3 | 300 |
| Rinse 1 | 40 | 33 | 3 | — |
| Rinse 2 | 40 | 33 | 3 | 320 |
| Drying | 30 | 80 | | |

The washing water was replenished by a so-called counter-flow system in which the overflow from the washing bath (2) is lead to the washing bath (1). In this case, the amount of the blix solution which was carried over from the blix bath to the washing bath (1) was 35 ml/m², the replenishment rate of the washing water being 9.1 times the amount of the blix solution carried over.

The respective processing solutions have the following compositions.

| | Running Solution | Replenisher |
|---|---|---|
| **Color developing solution** | | |
| D-sorbitol | 0.15 g | 0.20 g |
| Sodium naphthalenesulfonate-formalin condensate | 0.15 g | 0.20 g |
| Ethylenediaminetetrakis-methylenesulfonic acid | 1.5 g | 1.5 g |
| Diethylene glycol | 12.0 ml | 16.0 ml |
| Benzyl alcohol | 13.5 ml | 18.0 ml |
| Potassium bromide | 0.70 g | — |
| Brenzotriazole | 0.003 g | 0.004 g |
| Sodium sulfite | 2.4 g | 3.2 g |
| N,N-bis(carboxymethyl) hydrazine | 4.0 g | 5.3 g |
| D-glucose | 2.0 g | 2.4 g |
| Triethanolamine | 6.0 g | 8.0 g |
| N-ethyl-N-(β-methanesulfonamidoethyl)-3-methyl-4-aminoaniline sulfate | 6.4 g | 8.5 g |
| Potassium carbonate | 30.0 g | 25.0 g |
| Fluorescent brightening agent (diaminostilbene type) | 1.0 g | 1.2 g |
| Water to make | 1,000 ml | 1,000 ml |
| pH (25° C.) | 10.25 | 11.00 |
| **Blix Solution** | | |
| Disodium ethylenediamine-tetraacetate dihydrate | 2.0 g | same as left |
| Ammonium (ethylenediamine-tetraacetato)iron (III) dihydrate | 70.0 g | " |
| Ammonium thiosulfate (700 g/l) | 180 ml | |

-continued

| | Running Solution | Replenisher |
|---|---|---|
| Sodium p-toluenesulfonate | 45.0 g | " |
| Sodium bisulfite | 35.0 g | " |
| 5-Mercapto-1,3,4-triazole | 0.5 g | " |
| Ammonium nitrate | 10.0 g | " |
| Water to make | 1,000 ml | " |
| pH (25° C.) | 6.10 | " |

Washing Water

Prepared for both the running solution and the replenisher by passing tap water through a mixed bed column packed with an H type strongly acidic cation exchange resin ("Amberlite IR-120B, produced by Rhom & Haas Co.) and an OH type anion exchange resin ("Amberlite IR-400", produced by the same company) to reduce calcium and magnesium ion concentrations each to 3 mg/l, and then adding to the resulting water 20 mg/1 of sodium dichloroisocyanurate and 1.5 g/1 of sodium sulfate. The pH of the resulting solution was in the range of 6.5 to 7.5.

The direct positive image thus obtained was then measured for cyan color density.

Another batch of these specimens was subjected to ageing at 60° C. and 55% RH over 3 days, and then subjected to the same exposure, processing and measurement for density as effected previously.

The results are set forth in Table 2.

TABLE 2

| | | Before aging | | | | After aging at 60° C. - 55% RH over 3 days | | | |
|---|---|---|---|---|---|---|---|---|---|
| Specimen No. | Emulsion No. | Dmax | Dmin | Specific sensitivity | Gamma | Dmax | Dmin | Specific sensitivity | Gamma |
| 101 (Comparative Example) | A-1 | 2.05 | 0.35 | 100 | 1.5 | 1.53 | 0.50 | 110 | 1.0 |
| 102 (Comparative Example) | A-2 | 2.05 | 0.13 | 82 | 2.2 | 1.48 | 0.15 | 120 | 1.5 |
| 103 (Comparative Example) | A-3 | 2.05 | 0.09 | 70 | 2.5 | 1.47 | 0.13 | 115 | 1.6 |
| 104 (Comparative Example) | A-4 | 2.06 | 0.09 | 62 | 2.5 | 1.40 | 0.12 | 105 | 1.5 |
| 105 (Comparative Example) | A-5 | 2.08 | 0.17 | 84 | 2.1 | 1.48 | 0.23 | 126 | 1.4 |
| 106 (Comparative Example) | A-6 | 2.05 | 0.18 | 83 | 2.0 | 1.50 | 0.24 | 130 | 1.3 |
| 107 (Comparative Example) | A-7 | 2.04 | 0.33 | 100 | 1.5 | 1.62 | 0.47 | 110 | 1.0 |
| 108 (Comparative Example) | A-8 | 2.05 | 0.34 | 97 | 1.5 | 1.60 | 0.48 | 107 | 1.0 |
| 109 (Comparative Example) | A-9 | 2.04 | 0.35 | 100 | 1.5 | 1.60 | 0.50 | 109 | 1.1 |
| 110 (Comparative Example) | A-10 | 2.06 | 0.35 | 98 | 1.5 | 1.64 | 0.49 | 105 | 1.0 |
| 111 (Present invention) | A-11 | 2.05 | 0.12 | 97 | 2.3 | 1.84 | 0.14 | 105 | 2.1 |
| 112 (Present invention) | A-12 | 2.06 | 0.09 | 98 | 2.6 | 1.86 | 0.13 | 105 | 2.4 |
| 113 (Present invention) | A-13 | 2.06 | 0.10 | 100 | 2.5 | 1.88 | 0.13 | 104 | 2.3 |
| 114 (Present invention) | A-14 | 2.05 | 0.12 | 97 | 2.4 | 1.84 | 0.15 | 106 | 2.2 |
| 115 (Present invention) | A-15 | 2.04 | 0.10 | 95 | 2.5 | 1.85 | 0.13 | 101 | 2.3 |
| 116 (Present invention) | A-16 | 2.06 | 0.09 | 97 | 2.6 | 1.88 | 0.12 | 103 | 2.4 |
| 117 (Present invention) | A-17 | 2.04 | 0.13 | 102 | 2.2 | 1.83 | 0.16 | 110 | 1.9 |
| 118 (Present invention) | A-18 | 2.05 | 0.14 | 100 | 2.1 | 1.82 | 0.17 | 105 | 1.8 |
| 119 (Present invention) | A-19 | 2.04 | 0.10 | 98 | 2.5 | 1.81 | 0.14 | 106 | 2.2 |
| 120 (Present | A-20 | 2.05 | 0.10 | 100 | 2.5 | 1.84 | 0.14 | 108 | 2.3 |

TABLE 2-continued

| Specimen No. | Emulsion No. | Before aging Dmax | Dmin | Specific sensitivity | Gamma | After aging at 60° C. - 55% RH over 3 days Dmax | Dmin | Specific sensitivity | Gamma |
|---|---|---|---|---|---|---|---|---|---|
| invention) | | | | | | | | | |

Dmax, Dmin, sensitivity and gamma were determined as follows. Specifically, when the logarithm of the exposure is plotted as the abscissa and the cyan color density is plotted as the ordinate, a characteristic curve is obtained as shown in the Figure. With the cyan color density at the unexposed portion as Dmax, the cyan color density in the range having sufficient exposure as Dmin, and the reciprocal of the exposure required to obtain a predetermined cyan color density (D=1.0) as sensitivity, when the tangent line is drawn on the characteristic curve at the point at which the cyan color density is Dmin+(Dmax−Dmax)3, the inclination of the tangent line, with its sign reversed, is referred to as "gamma".

The value of "gamma" indicates the degree of gradation.

As compared to Specimen 101, Specimens 102 to 106 singly comprising the present compounds [I] to [III] can exhibit a low minimum image density (Dmin) while keeping the maximum image density (Dmax) high. These specimens also have a large gamma value, thus exhibiting a high contrast.

However, these specimens exhibit a lower sensitivity than Specimen 101. These specimens also exhibit a great drop in Dmax, a great fluctuation in sensitivity and a great drop in gamma value after ageing.

Specimens 107 to 110 singly comprising the present compounds [IV] to [VI] exhibit similar results in Dmin and the gamma value as Specimen 101. Thus, Specimens 107 to 110 do not provide any particularly preferred results.

As compared to these comparative specimens, the present specimens 111 to 120 comprising at least one of the present compounds [I] to [III] and at least one of the present compounds [IV] to [VI] in combination can exhibit a low Dmin while keeping the Dmax high. These specimens also exhibit a high sensitivity and a large gamma value, i.e., high contrast, providing the desired results.

Furthermore, the present specimens exhibit a small drop in Dmax, a small fluctuation in sensitivity and a small drop in gamma value after ageing, showing a small deterioration of photographic properties during storage.

EXAMPLE 2

Emulsions A-21 to A-25 were prepared in the same manner as for Emulsion A-13 except that the time of the incorporation of Compounds (I-16) and (IV-1) incorporated in the material was altered as set forth in Table 3.

TABLE 3

| Emulsion No. | Time of incorporation of Compounds (I-16) and (IV-1) |
|---|---|
| A-21 | During the formation of core emulsion (when 75% of silver nitrate to be used for formation of core is added) |
| A-16 | Shortly after the formation of core emulsion |
| A-22 | After the chemical sensitization of cores |

TABLE 3-continued

| Emulsion No. | Time of incorporation of Compounds (I-16) and (IV-1) |
|---|---|
| A-23 | During the formation of shell (when 50% of silver nitrate to be used for the formation of shell is added) |
| A-24 | Shortly after the formation of shells |
| A-25 | After the chemical sensitization of shells |

Specimens 221 to 225 were prepared in the same manner as for Specimen 101 except that Emulsions A-21 to A-25 were used instead of Emulsion A-1, respectively.

Specimen 231 was prepared in the same manner as in Specimen 101 except that Compound (I-16) and Compound (IV-1) were added to the coating solution for the 1st layer in amounts of $5\times10^{-4}$ mol/mol Ag and $3\times10^{-4}$ mol/mol Ag, respectively.

These specimens were then subjected to exposure and processing in the same manner as in Example 1. These specimens were then measured for the cyan color density of the resulting direct positive images. The results are set forth in Table 4.

TABLE 4

| Specimen No. | Emulsion No. | Dmax | Dmin | Specific sensitivity | Gamma |
|---|---|---|---|---|---|
| 101(comparative) | A-1 | 2.05 | 0.35 | 100 | 1.5 |
| 221(present invention) | A-21 | 2.05 | 0.10 | 98 | 2.6 |
| 116(present invention) | A-16 | 2.06 | 0.09 | 97 | 2.6 |
| 222(present invention) | A-22 | 2.03 | 0.12 | 100 | 2.3 |
| 223(present invention) | A-23 | 2.06 | 0.16 | 100 | 2.2 |
| 224(present invention) | A-24 | 2.05 | 0.16 | 98 | 2.1 |
| 225(present invention) | A-25 | 2.04 | 0.20 | 100 | 1.9 |
| 231(present invention) | A-1 | 2.05 | 0.27 | 100 | 1.9 |

As shown in Table 4, as compared to the specimen free of the present compounds, the specimens comprising the present compounds exhibit a large gamma value and hence a high contrast. These specimens also exhibit a small Dmin, providing the desired results. It is also shown that the time of incorporation of the present compounds is preferably effected during the formation of the emulsion, particularly during the formation of the cores or before the chemical sensitization of the cores, rather than after the preparation of the coating solution.

EXAMPLE 3

Specimen 301 was prepared in the same manner as for Specimen 101 except that the nucleating agent ExZK-1 and the nucleation accelerator Cpd-22 were not incorporated in the 1st layer (red-sensitive emulsion layer).

Specimens 302 to 306 were prepared in the same manner as for Specimen 301 except that Emulsions A-3, A-4, A-7, A-12 and A-13 were used instead of Emulsion A-1, respectively.

These specimens were then wedgewise exposed to light through a red filter over 1/10 second (20 CMS), and subjected to processing in the same manner as in Example 1. During the processing, these specimens were kept irradiated with light for 15 seconds from the beginning of the color development so that the illuminance on the light-sensitive film reached 0.5 lux (color temperature: 5,400 ° K).

These specimens were then measured for the cyan color density of the resulting direct positive images.

Another batch of these specimens was subjected to ageing at 65° C. and 55% RH over 3 days, and subjected to exposure, processing and density measurement in the same manner as described above.

The results are set forth in Table 5.

TABLE 5

| Specimen No. | Emulsion No. | Before aging Dmax | Dmin | Specific sensitivity | Gamma | After aging at 60° C. - 55% RH over 3 days Dmax | Dmin | Specific sensitivity | Gamma |
|---|---|---|---|---|---|---|---|---|---|
| 301(Comparative Example) | A-1 | 1.95 | 0.41 | 100 | 1.3 | 1.44 | 0.53 | 113 | 0.9 |
| 302(Comparative Example) | A-3 | 1.95 | 0.14 | 80 | 2.2 | 1.38 | 0.15 | 115 | 1.6 |
| 303(Comparative Example) | A-4 | 1.97 | 0.15 | 61 | 2.3 | 1.32 | 0.14 | 109 | 1.5 |
| 304(Comparative Example) | A-7 | 1.94 | 0.42 | 97 | 1.3 | 1.50 | 0.50 | 103 | 1.0 |
| 305(Present invention) | A-12 | 1.95 | 0.13 | 96 | 2.4 | 1.76 | 0.15 | 100 | 2.1 |
| 306(Present invention) | A-13 | 1.96 | 0.14 | 100 | 2.3 | 1.75 | 0.16 | 103 | 2.0 |

The present specimens 305 and 306 can exhibit a low Dmin while keeping Dmax high. These specimens also exhibit a high sensitivity and a large gamma value, i.e., high contrast, providing the desired results.

Furthermore, the present specimens exhibit a small drop in Dmax, a small fluctuation in sensitivity and a small drop in gamma value after ageing, showing a small deterioration of photographic properties during storage.

EXAMPLE 4

Preparation of Emulsion B-1

A mixed aqueous solution of potassium bromide and sodium chloride and an aqueous solution of silver nitrate were simultaneously added to an aqueous solution of gelatin comprising 3,4-dimethyl-1,3-thiazoline-2-thione in an amount of 0.3 g per mol of Ag with vigorous stirring at a temperature of 65° C. over about 14 minutes. As a result, a monodisperse emulsion of silver bromochloride grains having an average diameter of about 0.23 μm (silver bromide content: 80 mol %) was obtained. The emulsion was then heated to a temperature of 65° C. over 60 minutes with 61 mg/mol Ag of sodium thiosulfate and 41 mg/mol Ag of chloroauric acid (tetrahydrate) so that the grains were subjected to chemical sensitization. The silver bromochloride grains were then subjected to further shell formation in the same precipitation atmosphere as above. Eventually, a core/shell type monodisperse emulsion of silver bromochloride grains having an average diameter of about 0.65 μm (silver bromide content: 70 mol %) was obtained. The coefficient of fluctuation in the sizes of the silver bromochloride grains was about 12%. The emulsion was then heated to a temperature of 60° C. over 60 minutes with 1.5 mg/mol Ag of sodium thiosulfate and 1.5 mg/mol Ag of chloroauric acid (tetrahydrate) so that the silver bromochloride grains were subjected to chemical sensitization. As a result, an internal latent image type silver halide emulsion B-1 was obtained.

Emulsions B-2 to B-20 were then prepared in the same manner as for Emulsion B-1 except that the compounds set forth in Table 6 were incorporated in the material shortly after the formation of each core emulsion, respectively.

TABLE 6

| Emulsion No. | Compound(I)/added amount (mol/molAg) | Compound(II)/added amount (mol/molAg) | Compound(III)/added amount (mol/molAg) | Compound(IV)/added amount (mol/molAg) |
|---|---|---|---|---|
| B-1 | — | — | — | — |
| B-2 | (I-2) $5 \times 10^{-4}$ | — | — | — |
| B-3 | — | (II-3) $5 \times 10^{-4}$ | — | — |
| B-4 | — | — | (III-1) $5 \times 10^{-4}$ | — |
| B-5 | — | — | — | (IV-1) $3 \times 10^{-4}$ |
| B-6 | (I-16) $5 \times 10^{-4}$ | — | — | (IV-1) $3 \times 10^{-4}$ |
| B-7 | — | (II-3) $5 \times 10^{-4}$ | — | (IV-1) $3 \times 10^{-4}$ |
| B-8 | — | — | (III-1) $5 \times 10^{-4}$ | (IV-1) $3 \times 10^{-4}$ |

Specimen 401 was prepared in the same manner as for Specimen 301 of Example 3 except that Emulsion B-1 was used instead of Emulsion A-1. Specimens 402 to 408 were prepared in the same manner as for Specimen 401 except that Emulsions B-2 to B-8 were used instead of Emulsion B-1, respectively.

These specimens were subjected to the same exposure and processing as effected in Example 3. These specimens were then measured for the cyan color density of the resulting direct positive images.

Another batch of these specimens was subjected to ageing at 60° C. and 55% RH over 3 days. These specimens were then subjected to exposure, processing and density measurement in the same manner as effected above.

The results are set forth in Table 7.

TABLE 7

| Specimen No. | Emulsion No. | Before aging Dmax | Dmin | Specific sensitivity | Gamma | After aging at 60° C. - 55% RH over 3 days Dmax | Dmin | Specific sensitivity | Gamma |
|---|---|---|---|---|---|---|---|---|---|
| 401(Comparative Example) | B-1 | 2.31 | 0.48 | 100 | 1.3 | 1.80 | 0.57 | 120 | 0.8 |
| 402(Comparative Example) | B-2 | 2.25 | 0.15 | 53 | 2.4 | 1.75 | 0.19 | 105 | 1.8 |
| 403(Comparative Example) | B-3 | 2.30 | 0.18 | 67 | 2.3 | 1.78 | 0.23 | 102 | 1.7 |
| 404(Comparative Example) | B-4 | 2.27 | 0.20 | 79 | 2.2 | 1.80 | 0.25 | 109 | 1.5 |
| 405(Comparative Example) | B-5 | 2.31 | 0.48 | 100 | 1.3 | 2.05 | 0.54 | 102 | 0.9 |
| 406(Present invention) | B-6 | 2.28 | 0.15 | 95 | 2.4 | 2.07 | 0.19 | 101 | 2.1 |
| 407(Present invention) | B-7 | 2.30 | 0.17 | 98 | 2.3 | 2.05 | 0.22 | 103 | 2.0 |
| 408(Present invention) | B-8 | 2.29 | 0.20 | 100 | 2.3 | 2.08 | 0.25 | 105 | 2.0 |

The present specimens 406 to 408 can exhibit a low Dmin while keeping Dmax high. These specimens also exhibit a high sensitivity and a large gamma value, i.e., high contrast providing the desired results.

Furthermore, the present specimens exhibit a small drop in Dmax, a small fluctuation in sensitivity and a small drop in gamma value after ageing, showing a small deterioration of photographic properties during storage.

EXAMPLE 5

A color photosensitive material comprising a polyethylene double-laminated paper support (thickness: 100 μm) having coated on the surface side thereof 1st and 14th layers shown below and on the back side thereof 15th to 16th layers shown below was prepared. The polyethylene layer on the side to be coated with the 1st layer contained titanium oxide as a white pigment and a trace amount of ultramarine as a bluing dye.

Composition of light-sensitive layer

The components and spreads (unit: g/m$^2$, hereinafter the same) will be set forth below. The spread of silver halide is represented as calculated in terms of amount of silver. The emulsion used in each layer was prepared in accordance with the method for preparing an emulsion A-1, provided that the emulsion used in the 14th layer was a Lippman emulsion not having been subjected to surface chemical sensitization.

| | |
|---|---|
| **1st Layer (Antihalation Layer):** | |
| Black colloidal layer | 0.10 |
| Gelatin | 0.70 |
| **2nd Layer (Intermediate Layer):** | |
| Gelatin | 0.70 |
| **3rd Layer (Low Sensitivity Red-Sensitive Layer):** | |
| Silver bromide (mean grain size: 0.30 μm; size distribution (coefficient of fluctuation): 8%; octahedron) spectrally sensitized with red-sensitizing dyes (ExS-1,2 and 3) | 0.04 |
| Silver bromide (mean grain size: 0.40 μm; size distribution (coefficient of fluctuation): 10%; octahedron) spectrally sensitized with red-sensitizing dyes (ExS-1,2 and 3) | 0.08 |
| Gelatin | 1.00 |
| Cyan coupler (ExC-1,2 and 3 at a mol ratio of 1:1:0.2) | 0.30 |
| Discoloration inhibitor (Cpd-1,2,3 and 4 at an equimolar ratio) | 0.18 |
| Stain inhibitor (Cpd-5) | 0.003 |
| Coupler dispersing medium (Solv-1,2 and 3 at an equimolar ratio) | 0.03 |
| Coupler solvent (Solv-1,2 and 3 at an equimolar ratio) | 0.12 |
| **4th Layer (High Sensitivity Red-Sensitive Layer):** | |
| Silver bromide (mean grain size: 0.60 μm; size distribution: 15%; octahedron) spectrally sensitized with red-sensitizing dyes (ExS-1,2 and 3) | 0.14 |
| Gelatin | 1.00 |
| Cyan coupler (ExC-1,2 and 3 at a mole ratio of 1:1:0.2) | 0.30 |
| Discoloration inhibitor (Cpd-1,2,3 and 4 at an equimolar ratio) | 0.18 |
| Coupler dispersing medium (Cpd-6) | 0.03 |
| Coupler solvent (Solv-1,2 and 3 at an equimolar ratio) | 0.12 |
| **5th Layer (Intermediate Layer):** | |
| Gelatin | 1.00 |
| Discoloration inhibitor (Cpd-7) | 0.08 |
| Color stain inhibitor solvent (Solv-4 and 5 at an equimolar ratio) | 0.16 |
| Polymer latex (Cpd-8) | 0.10 |
| **6th Layer (Low Sensitivity Green-Sensitive Layer):** | |
| Silver bromide (mean grain size: 0.25 μm; size distribution: 8%; octahedron) spectrally sensitized with green-sensitizing dye (ExS-4) | 0.04 |
| Silver bromide (mean grain size: 0.40 μm; size distribution: 10%; octahedron) spectrally sensitized with green-sensitizing dye (ExS-4) | 0.06 |
| Gelatin | 0.80 |
| Magenta coupler (ExM-1,2 and 3 at an equimolar ratio) | 0.11 |
| Discoloration inhibitor (Cpd-9 and 26 at an equimolar ratio) | 0.15 |
| stain inhibitor (Cpd-10,11,12, and 13 at a mole ratio of 10:7:7:1) | 0.025 |
| Coupler dispersing medium (Cpd-6) | 0.05 |
| Coupler solvent (Solv-4 and 6 at an equimolar ratio) | 0.15 |
| **7th Layer (High Sensitivity Green-Sensitive Layer):** | |
| Emulsion A-1 (mean grain size: 0.70 μm; size distribution: 10%; octahedron) spectrally sensitized with green-sensitizing dye (ExS-4) | 0.10 |
| Gelatin | 0.80 |
| Magenta coupler (ExM-1,2 and 3 at an equimolar ratio) | 0.1 |
| Discoloration inhibitor (Cpd-9 and 26 at an equimolar ratio) | 0.15 |
| Stain inhibitor (Cpd-10,11,12 and 13 at a mole ratio of 10:7:7:1) | 0.025 |

-continued

| | |
|---|---|
| Coupler dispersing medium (Cpd-6) | 0.05 |
| Coupler solvent (Solv-4 and 6 at an equimolar ratio) | 0.15 |
| **8th Layer (Intermediate Layer):** | |
| Same as 5th layer | |
| **9th Layer (Yellow Filter Layer):** | |
| Yellow colloidal silver | 0.12 |
| Gelatin | 0.07 |
| Discoloration inhibitor (Cpd-7) | 0.03 |
| Color stain inhibitor solvent (Solv-4 and 5 at an equimolar ratio) | 0.10 |
| Polymer latex (Cpd-8) | 0.07 |
| **10th Layer (Intermediate Layer):** | |
| Same as 5th layer | |
| **11th Layer (Low Sensitivity Blue-Sensitive Layer):** | |
| Silver bromide (mean grain size: 0.40 μm; size distribution: 8%; octahedron) spectrally sensitized with blue-sensitizing dyes (ExS-5 and 6) | 0.07 |
| Silver bromide (mean grain size: 0.60 μm; size distribution: 11%; octahedron) spectrally sensitized with blue-sensitizing dyes (ExS-5 and 6) | 0.14 |
| Gelatin | 0.80 |
| Yellow coupler (ExY-1 and 2 at an equimolar ratio) | 0.35 |
| Discoloration inhibitor (Cpd-14) | 0.10 |
| Stain inhibitor (Cpd-5 and 15 at mole a ratio of 1:5) | 0.007 |
| Coupler dispersing medium (Cpd-6) | 0.05 |
| Coupler solvent (Solv-2) | 0.10 |
| **12th Layer (High Sensitivity Blue-Sensitive Layer):** | |
| Silver bromide (mean grain size: 0.85 μm:; size distribution: 18%; octahedron) spectrally sized with blue-sensitizing dyes (ExS-5 and 6) | 0.15 |
| Gelatin | 0.60 |
| Yellow coupler (ExY-1 and 2 at an equimolar ratio) | 0.30 |
| Discoloration inhibitor (Cpd-14) | 0.10 |
| Stain inhibitor (Cpd-5 and 15 at mole a ratio of 1:5) | 0.007 |
| Coupler dispersing medium (Cpd-6) | 0.05 |
| Coupler solvent (Solv-2) | 0.10 |
| **13th Layer (Ultramarine Absorbing Layer):** | |
| Gelatin | 1.00 |
| Ultraviolet Absorbent (Cpd-2,4 and 16 at an equimolar ratio) | 0.50 |

-continued

| | |
|---|---|
| Discoloration inhibitor (Cpd-7 and 17 at an equimolar ratio) | 0.03 |
| Dispersing medium (Cpd-6) | 0.02 |
| Ultraviolet Absorbent Solvent (Solv-2 and 7 at an equimolar ratio) | 0.08 |
| Anti-irradiation dye (Cpd-18,19,20,21 and 27 at a mole ratio of 10:10:13:15:20) | 0.05 |
| **14th Layer (Protective Layer):** | |
| Fine silver bromochloride grains (silver chloride content: 97 mol %; mean grain size: 0.1 μm) | 0.03 |
| Acryl-modified copolymer of polyvinyl alcohol | 0.01 |
| Polymethyl methacrylate particles (mean grain size: 2.4 μm) and silicon oxide (mean grain size: 5 μm) | 0.05 |
| Gelatin | 1.80 |
| Gelatin hardener (H-1 and H-2 at an equimolar ratio) | 0.18 |
| **15th Layer (Backing Layer):** | |
| Gelatin | 2.50 |
| Ultraviolet absorbent (Cpd-2,4 and 16 at an equimolar ratio) | 0.50 |
| Dyes (Cpd-18,19,20,21 and 27 at an equimolar ratio) | 0.06 |
| **16th Layer (Back Protective Layer):** | |
| Polymethyl methacrylate particles (mean grain size: 2.4 μm) and silicon oxide (mean grain size: 5 μm) at an equimolar ratio | 0.05 |
| Gelatin | 2.00 |
| Gelatin hardener (H-1 and H-2 at an equimolar ratio) | 0.14 |

Each of the light-sensitive layers further contained ExZK-1 and ExZK-2 as nucleating agents and Cpd-22 as a nucleation accelerator in amounts of $10^{-3}$, $10^{-2}$ and $10^{-2}$% by weight based on silver halide, respectively. Furthermore, each layer contained Alkanol XC (produced by Dupont) and a sodium alkylbenzenesulfonate as emulsifying and dispersing assistants, a succinic ester and Magefac F-120 (produced by Dainippon Ink & Chemicals, Inc.) as coating aids. The silver halide- or colloidal silver- containing layers comprised Cpd-23, 24 and 25 as stabilizers. The compounds used in this example will be set forth below.

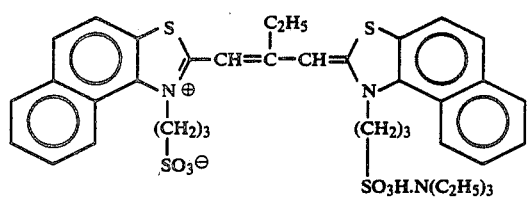

ExS-1

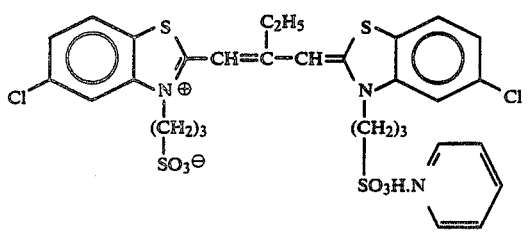

ExS-2

-continued
ExS-3
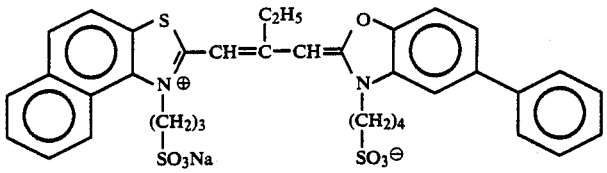
ExS-4
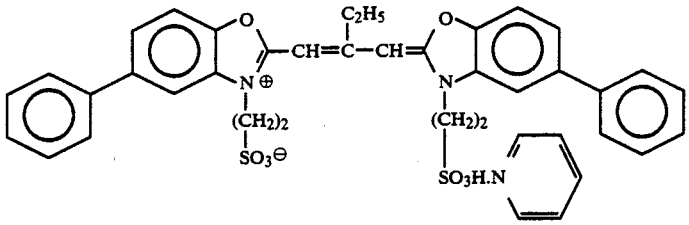
ExS-5
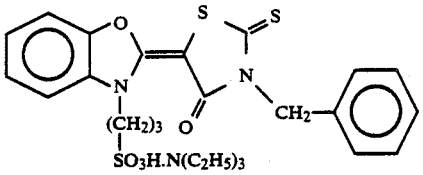
ExS-6
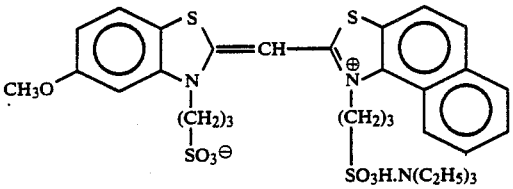
Cpd-1
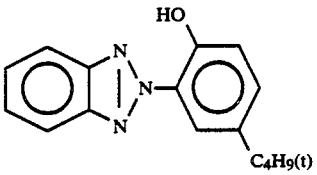
Cpd-2
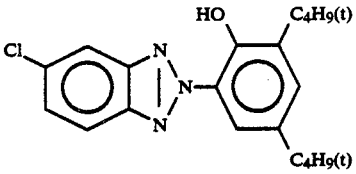
Cpd-3
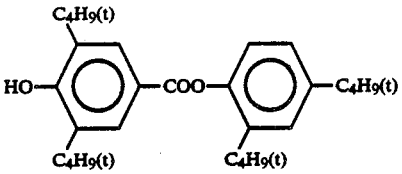
Cpd-4
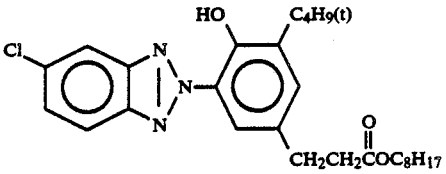

-continued
Cpd-5
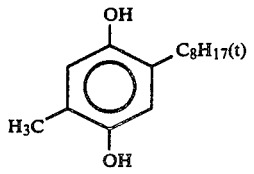
Cpd-6
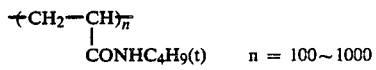
Cpd-7
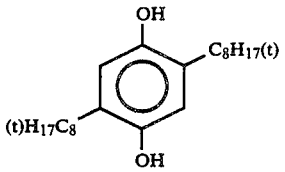
Cpd-8
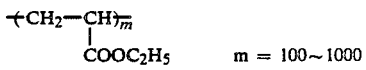
Cpd-9
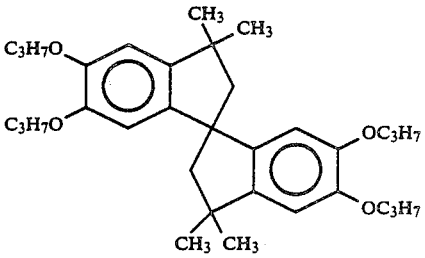
Cpd-10
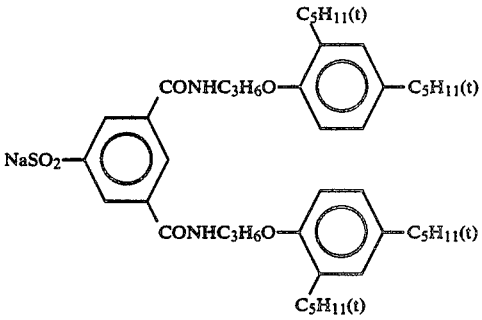
Cpd-11
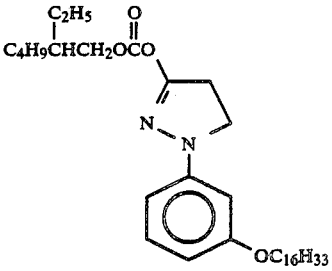
Cpd-12
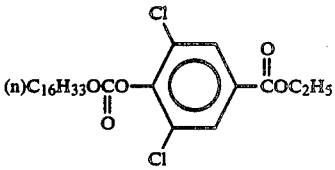

-continued
Cpd-13
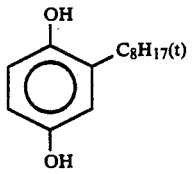
Cpd-14
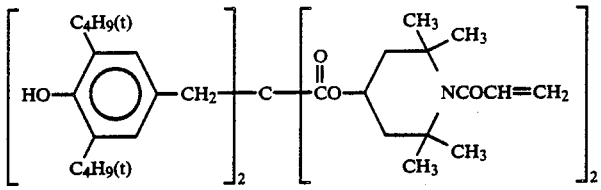
Cpd-15
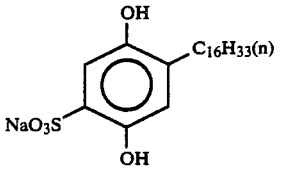
Cpd-16
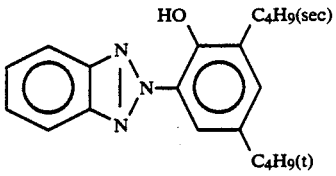
Cpd-17
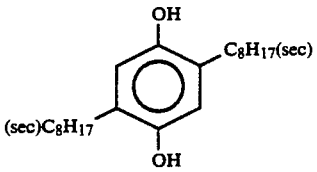
Cpd-18
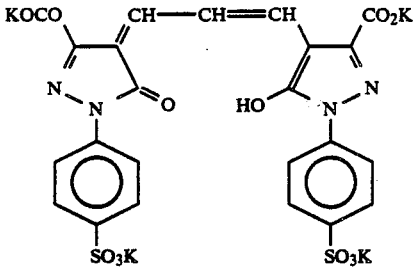
Cpd-19
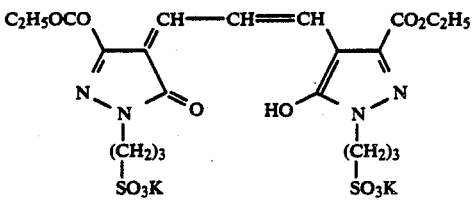

-continued
Cpd-20
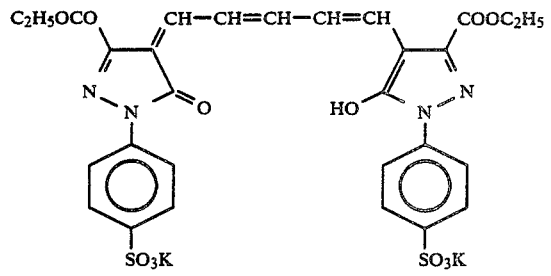
Cpd-21
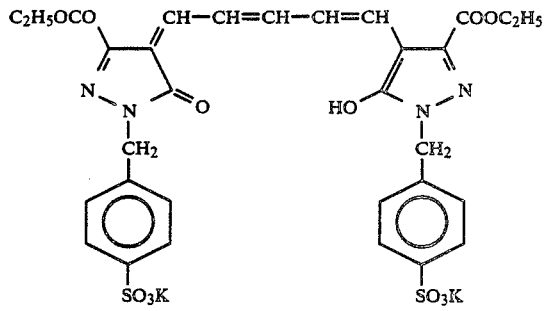
Cpd-22
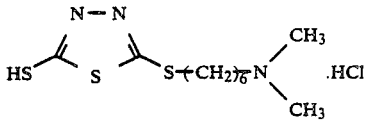
Cpd-23
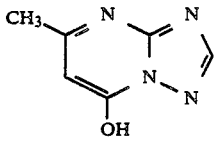
Cpd-24
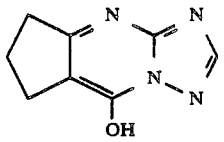
Cpd-25
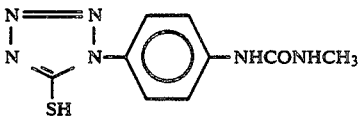
Cpd-26
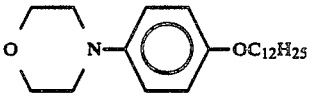
Cpd-27
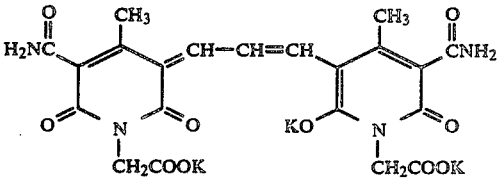

-continued
ExC-1
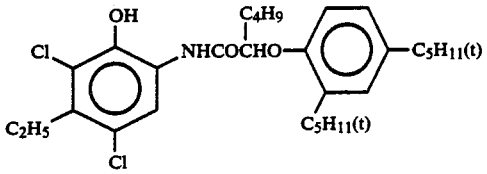
ExC-2
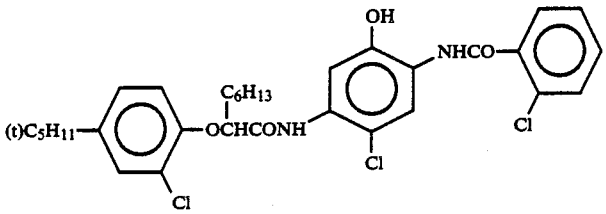
ExC-3
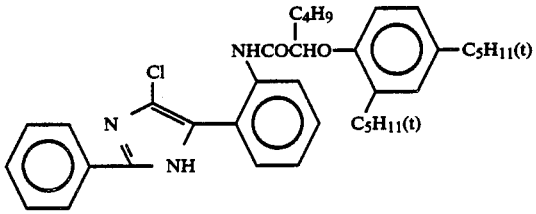
ExM-1
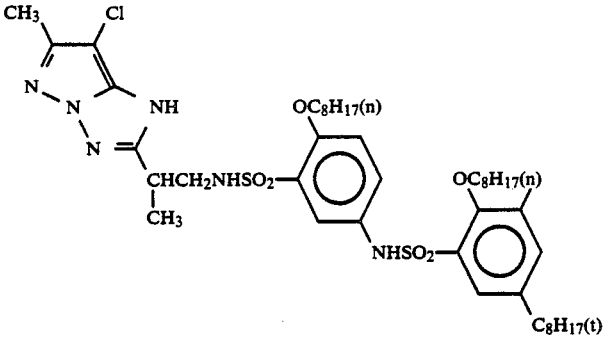
ExM-2
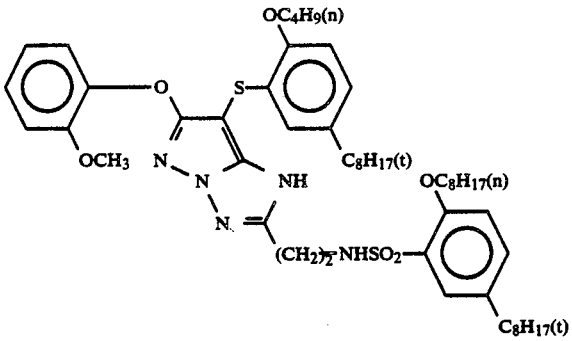
ExM-3
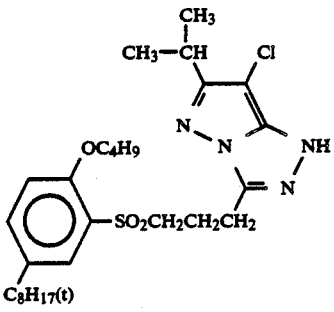

-continued

ExY-1

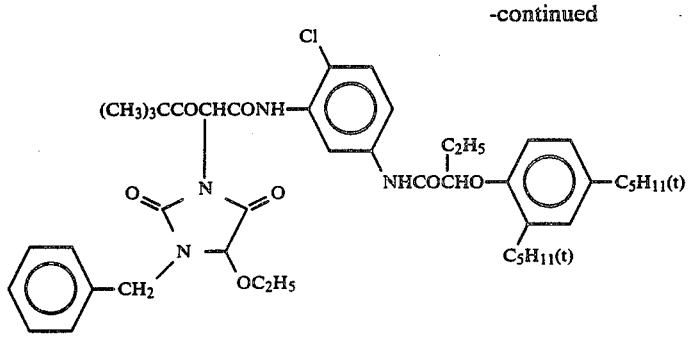

ExY-1

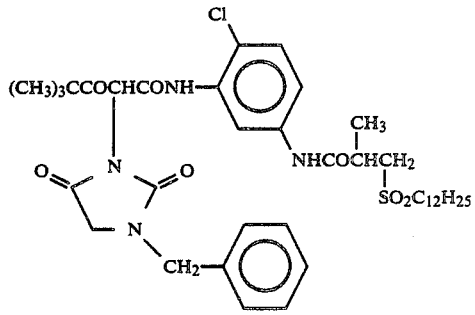

Solv-1: Di(2-ethylhexyl)sebacate
Solv-2: Trinonyl phosphate
Solv-3: Di(3-methylhexyl)phthalate
Solv-4: Tricresyl phosphate
Solv-5: Dibutyl phthalate
Solv-6: Trioctyl phosphate
Solv-7: Di(2-ethylhexyl)phthalate
H-1: 1,2-Bis(vinylsulfonylacetamide)ethane
H-2: 4,6-Dichloro-2-hydroxy-1,3,5-triazine sodium salt
ExZK-1: 7-(3-Ethoxythiocarbonylaminobenzamide)-9-methyl-10-propargyl-1,2,3,4-tetrahydroacrylidiniumtrifluoromethane sulfonate
ExZK-2: 2-[4-{3-[3-{3-[5-{3-[2-Chloro-5-(1-dodecyloxycarbonylethoxy-carbonyl)phenylcarbamoyl]-4-hydroxy-1-naphthylthio}tetrazol-1-yl]phenyl}ureido]benzenesulfonamide}phenyl]-1-formylhydrazine Specimens 502 to 506 were prepared in the same manner as for Specimen 501 except that Emulsions A-3, A-4, A-7, A-12 and A-13 were used, respectively, instead of Emulsion A-1 to be incorporated in the 7th layer.

These specimens were then subjected to the same wedgewise exposure (1/10 second; 30 CMS) and processing as effected in Example 1.

These specimens were then measured for the cyan color density of the resulting direct positive images.

Another batch of these specimens was subjected to ageing at 60° C. and 55% RH over 3 days. These specimens were then subjected to exposure, processing and density measurement in the same manner as effected above.

The results are set forth in Table 8.

TABLE 8

| | | Before aging | | | | After aging at 60° C. - 55% RH over 3 days | | | |
|---|---|---|---|---|---|---|---|---|---|
| Specimen No. | Emulsion No. | Dmax | Dmin | Specific sensitivity | Gamma | Dmax | Dmin | Specific sensitivity | Gamma |
| 501(Comparative Example) | A-1 | 2.45 | 0.38 | 100 | 1.1 | 1.80 | 0.48 | 130 | 0.9 |
| 502(Comparative Example) | A-3 | 2.45 | 0.15 | 68 | 1.5 | 1.75 | 0.19 | 105 | 1.1 |
| 503(Comparative Example) | A-4 | 2.47 | 0.16 | 56 | 1.5 | 1.78 | 0.20 | 104 | 1.1 |
| 504(Comparative Example) | A-7 | 2.42 | 0.38 | 100 | 1.1 | 2.10 | 0.47 | 115 | 0.9 |
| 505(Present invention) | A-12 | 2.45 | 0.15 | 98 | 1.6 | 2.12 | 0.19 | 102 | 1.4 |
| 506(Present invention) | A-13 | 2.44 | 0.15 | 100 | 1.5 | 2.11 | 0.19 | 107 | 1.3 |

The present specimens 505 and 506 can exhibit a low Dmin while keeping Dmax high. These specimens also exhibit a high sensitivity and a large gamma value, i.e., high contrast, providing the desired results.

Furthermore, the present specimens exhibit a small drop in Dmax, a small fluctuation in sensitivity and a small drop in gamma value after ageing, showing a small deterioration of photographic properties during storage.

While the invention has been described in detail and with reference to specific embodiments thereof, it will be apparent to one skilled in the art that various changes and modifications can be made therein without departing from the spirit and scope thereof.

What is claimed is:

1. A direct positive photosensitive material comprising a support having thereon at least one photographic emulsion layer containing core/shell type internal latent image type silver halide grains not having been previously fogged, wherein said photographic emulsion layer comprises:

(1) at least one of compounds represented by formulae (I), (II), (III); and (2) at least one of compounds represented by formulae (IV), (V) and (VI):

$$R—SO_2S—M \quad (I)$$

$$R—SO_2S—R^1 \quad (II)$$

$$R—SO_2S—Lm—S{\cdot}O_2S—R^2 \quad (III)$$

wherein R, $R^1$ and $R^2$ may be the same or different and each represents an aliphatic group, aromatic group or heterocyclic group; m represents a cation; L represents a divalent connecting group; and m represents 0 or 1;

$$M'_2SO_3 \quad (IV)$$

$$M'HSO_3 \quad (V)$$

$$M'_2S_2O_5 \quad (VI)$$

wherein

M' represents a hydrogen atom or cation;

said emulsion layer having been obtained by incorporating said at least one of compounds represented by formulae (I), (II) and (III) and said at least one of compounds represented by formulae (IV), (V) and (VI) into a core/shell emulsion during the stages of formation or chemical sensitization of core grains.

2. The direct positive photosensitive material according to claim 1, wherein an amount of the compound represented by formula (I), (II) or (III) is in the range of $10^{-6}$ to $10^{-2}$ mol per mol of the internal latent image type silver halide.

3. The direct positive photosensitive material according to claim 1, wherein the amount of the compound represented by formula (IV), (V) or (VI) is in the range of $10^{-7}$ to $10^{-3}$ mol per mol of the internal latent image type silver halide.

4. The direct positive photosensitive material according to claim 1, wherein said photosensitive material further comprises a nucleating agent represented by general formula [N-I] or [N-II]:

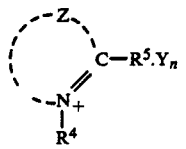

[N-I]

wherein Z represents a nonmetallic atom group required to form a 5- to 6-membered heterocyclic group and may be substituted by substituents; $R^4$ represents an aliphatic group; $R^5$ represents a hydrogen atom, aliphatic group or aromatic group; $R^4$ and $R^5$ may be substituted by substituents; $R^5$ may be connected to a heterocyclic group formed of Z to form a ring; at least one of the substituents contained in $R^4$, $R^5$ and Z may contain a group for accelerating the adsorption by silver halide; Y represents a paired ion for charge balance; and n represents 0 or 1, with the proviso that at least one of the groups represented by $R^4$, $R^5$ and Z contains an alkynyl group, acyl group, hydrazine group or hydrazone group of $R^4$ and $R^5$ together form a 6-membered ring to form a dihydropyridinium skeleton;

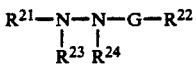

[N-II]

wherein $R^{21}$ represents an aliphatic group, aromatic group or heterocyclic group; $R^{22}$ represents a hydrogen atom, alkyl group, aralkyl group, aryl group, alkoxy group, aryloxy group or amino group; G represents a carbonyl group, sulfonyl group, sulfoxy group, phosphoryl group or iminomethylene group (HN=C<); and $R^{23}$ and $R^{24}$ each represents a hydrogen atom or one of $R^{23}$ and $R^{24}$ represents a hydrogen atom and the other represents any on of an alkylsulfonyl group, an arylsulfonyl group and an acyl group, with the proviso that G, $R^{22}$, $R^{24}$ and a hydrazine nitrogen may together form a hydrazo structure(>N—N=C<).

* * * * *